US010850915B2

(12) United States Patent
De Maillard et al.

(10) Patent No.: US 10,850,915 B2
(45) Date of Patent: Dec. 1, 2020

(54) VALVE HOLDING DEVICE

(71) Applicant: INOSPRAY, Nersac (FR)

(72) Inventors: Thibault De Maillard, Angouleme (FR); Jean-Luc Beurcq, Angouleme (FR)

(73) Assignee: INOSPRAY (FR)

( * ) Notice: Subject to any disclaimer, the term of this patent is extended or adjusted under 35 U.S.C. 154(b) by 0 days.

(21) Appl. No.: 16/486,179

(22) PCT Filed: Feb. 15, 2018

(86) PCT No.: PCT/FR2018/050366

§ 371 (c)(1),
(2) Date: Aug. 20, 2019

(87) PCT Pub. No.: WO2018/150142

PCT Pub. Date: Aug. 23, 2018

(65) Prior Publication Data

US 2019/0375577 A1 Dec. 12, 2019

(30) Foreign Application Priority Data

Feb. 20, 2017 (FR) ..... 17 51338

(51) Int. Cl.
*B65D 83/20* (2006.01)
*B65D 83/24* (2006.01)
(Continued)

(52) U.S. Cl.
CPC ..... *B65D 83/202* (2013.01); *B65D 83/24* (2013.01); *B65D 83/32* (2013.01); *B65D 83/38* (2013.01);
(Continued)

(58) Field of Classification Search
CPC ..... B65D 83/202; B65D 83/24; B65D 83/62; B65D 83/0061; B65D 83/756;
(Continued)

(56) References Cited

U.S. PATENT DOCUMENTS 3,154,223 A 10/1964 Messmer
3,662,926 A * 5/1972 Umstead ..... B65D 83/62 222/95
(Continued)

FOREIGN PATENT DOCUMENTS

EP 2487120 A1 * 8/2012
EP 2551215 1/2013
(Continued)

OTHER PUBLICATIONS

International Search Report, International Application No. PCT/FR2018050366, dated May 3, 2018.

*Primary Examiner* — Lien M Ngo
(74) *Attorney, Agent, or Firm* — Perman & Green, LLP

(57) ABSTRACT

A combined lid/valve device including a lid, for a pressurised product dispensing container, and a valve mechanism, in which the lid is provided with a so-called upper face and a so-called lower face, in which the lower face of the lid includes a base provided with a skirt for receiving the neck of a pocket containing the product to be dispensed, the base forming a housing for the valve mechanism consisting of a dispensing tube and a sealing gasket, the sealing gasket mounted on the dispensing tube snap-fitting into a through-hole between the upper face and lower face of the lid and allowing an outlet end of the dispensing tube to project beyond the upper face of the lid.

10 Claims, 4 Drawing Sheets

(51) Int. Cl.

| | |
|---|---|
| *B65D 83/32* | (2006.01) |
| *B65D 83/38* | (2006.01) |
| *B65D 83/42* | (2006.01) |
| *B65D 83/48* | (2006.01) |
| *B65D 83/62* | (2006.01) |

(52) U.S. Cl.
CPC ..... *B65D 83/42* (2013.01); *B65D 83/48* (2013.01); *B65D 83/62* (2013.01)

(58) Field of Classification Search
CPC ..... B65D 83/32; B65D 83/38; B65D 83/42; B65D 83/48; B29C 73/16
USPC ..... 222/402.1, 402.25, 95, 105, 321, 383.1, 222/464.1
See application file for complete search history.

(56) References Cited

U.S. PATENT DOCUMENTS

| | | | | |
|---|---|---|---|---|
| 4,260,080 | A | 4/1981 | Gailitis | |
| 4,969,577 | A | 11/1990 | Werding | |
| 5,305,921 | A * | 4/1994 | Kock | B65D 83/0055 222/95 |
| 2012/0291911 | A1* | 11/2012 | Smith | B65B 3/045 141/3 |
| 2015/0014990 | A1* | 1/2015 | Bodet | F16L 23/04 285/406 |
| 2016/0167868 | A1 | 6/2016 | De Maillard et al. | |
| 2016/0377186 | A1* | 12/2016 | Smith | F16K 3/26 251/325 |
| 2018/0022536 | A1* | 1/2018 | Borel | B65D 83/42 141/3 |
| 2018/0222613 | A1* | 8/2018 | Geier | B65B 31/028 |

FOREIGN PATENT DOCUMENTS

| | | |
|---|---|---|
| EP | 3019420 | 5/2016 |
| FR | 2951140 | 4/2011 |
| FR | 3032435 | 8/2016 |
| JP | 2015058980 | 3/2015 |
| WO | 2016124622 | 8/2016 |
| WO | 2016210217 | 12/2016 |

* cited by examiner

VALVE HOLDING DEVICE

CROSS REFERENCE TO RELATED APPLICATIONS

This application is a National Stage of International Application No. PCT/FR2018/050366, having an International Filing Date of 15 Feb. 2018, which designated the United States of America, and which International Application was published under PCT Article 21(2) as WO Publication No. 2018/150142 A1, which claims priority from and the benefit of French Patent Application No. 1751338, filed on 20 Feb. 2017, the disclosures of which are incorporated herein by reference in their entireties.

BACKGROUND

1. Field

The presently disclosed embodiment relates to pocket tanks for pressurised product dispensing casings and casings comprising such pocket tanks. It is applied to pressurised aerosol, liquid or pasty product dispensing casings comprising a pocket tank containing the product to be dispensed and in particular, to refillable casings. The presently disclosed embodiment relates to an improved valve holding device being mounted on a pocket of a pocket tank.

2. Brief Description of Related Developments

French Document 2 951 140 A1 in the name of the applicant describes a pocket tank embodiment comprising a pocket having an outlet connected to a valve mounted on a dome, the dome comprising a supporting edge being positioned on the upper edge of a cylindrical tank housing the pocket and adapted to be filled around the pocket by a propellant. European Document 3 019 420 A1 in the name of the applicant relates to a pocket tank for pressurised dispending casing, comprising a valve holding device formed by a dome, a valve holding cup, the base in the lower portion of the dome and the bowl in the upper portion communicating by a central hole for filling the pocket and exiting the product from the latter.

French Document 3 032435 A1 describes a large flow valve mounted in a cup intended to be mounted on a pressurised tank dome.

European Document 2 551 215 A1 describes a pocket aerosol casing in which a standard valve is fixed in a plastic dome, either by means of a metal cup, or directly.

SUMMARY

The presently disclosed embodiment aims, on the one hand, to improve a pocket refill dispensing casing and to integrate the valve in a lid of the casing, and on the other hand, to make it possible to connect an accessory device on the casing, for example, a pressurised connector tube.

To do this, the presently disclosed embodiment proposes a combined lid/valve device comprising a lid, for a pressurised product dispensing container, and a valve mechanism, in which the lid is provided with a so-called upper face and a so-called lower face, in which the lower face of the lid comprises a base provided with a skirt for receiving the neck of a pocket containing the product to be dispensed, in which the base forms a housing for the valve mechanism consisting of a dispensing tube and a sealing gasket and in which the sealing gasket mounted on the dispensing tube snap-fits in a through-hole between the upper face and the lower face of the lid by allowing an outlet end of the dispensing tube to project beyond the upper face of the lid.

The device of the disclosed embodiment, in particular, has the advantage of removing any crimping at the level of the valve or of the lid.

Advantageously, the upper face of the lid comprises means for fixing an accessory for dispensing the product.

According to a specific aspect of the disclosed embodiment, the accessory consists of a connector tip provided with a collar for fixing the connector tip on the upper face of the lid, of a tubular portion for receiving the outlet end of the dispensing tube and provided with an outlet tube, in which the tubular portion of the connector tip is sized to push the dispensing tube and open the valve for dispensing the product during the fixing of the connector tip on the lid.

The collar for fixing the connector tip can comprise peripheral strips being housed in grooves, notches or blocking slots arranged on the upper face of the lid, said grooves, notches or slots forming said fixing means.

The housing more specifically comprises a first cross-section for receiving the valve mechanism and a second cross-section for receiving an anti-lowering dip rod.

The combined device according to the disclosed embodiment can further comprise a centring device for holding the dip rod in said second cross-section of the housing.

The centring device is advantageously perforated to produce channels for the passage of product to be dispensed.

The accessory can, in an alternative aspect of the disclosed embodiment, consist of a dispensing tip or a dispensing gun.

The disclosed embodiment is applied to a refill, for a pressurised product dispensing casing, comprising a combined lid/valve device.

The refill is advantageously provided with an anti-lowering dip rod in which the dip rod comprises two mounts connected by bars for keeping the mounts away from one another.

According to an advantageous aspect of the disclosed embodiment, the rod comprises teeth, facing the flattening of the pocket on the rod. The rod can complementarily or alternatively comprise indentations expanding the product passage zones in the space defined by the dip rod.

The disclosed embodiment relates to a pressurised product dispensing casing, comprising a refill provided with the combined lid/valve device of the invention and in which the combined lid/valve device is held on the container of the casing by a fixed ring on the container.

BRIEF DESCRIPTION OF THE DRAWINGS

Other features and advantages of the disclosed embodiment will be clear upon reading the following description of a non-limiting example of the disclosed embodiment, in reference to the drawings which represent.

DETAILED DESCRIPTION

Figures 1, 1A:
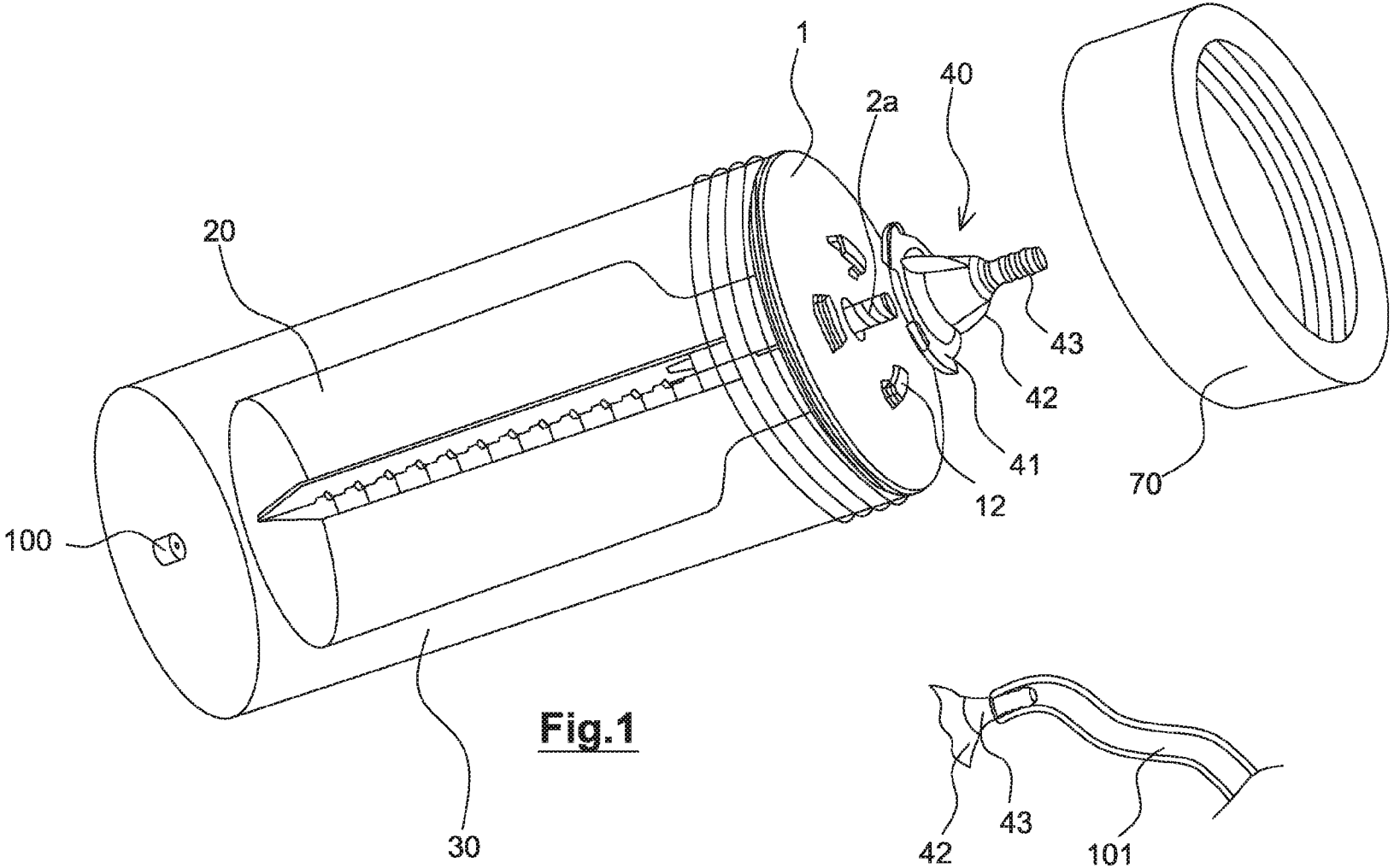
in FIG. 1: a perspective view of a pocket tank provided with a combined lid/valve device of the disclosed embodiment.
in FIG. 1A: a perspective view of a detail.

FIG. 1 represents a pressurised product dispensing casing comprising a container 30 provided with a gas valve 100 and receiving a pocket 20 filled with a liquid or pasty product to be dispensed.

The casing is closed by a lid 1 fixed on the container according to the example by means of a screwed ring 70 which keeps flat a lid 1 on the casing, in a sealed manner.

According to the presently disclosed embodiment, the lid is a combined lid/valve device and the outlet of the product dispensing valve is made by a tube 2*a* passing through the lid.

Figure 2:
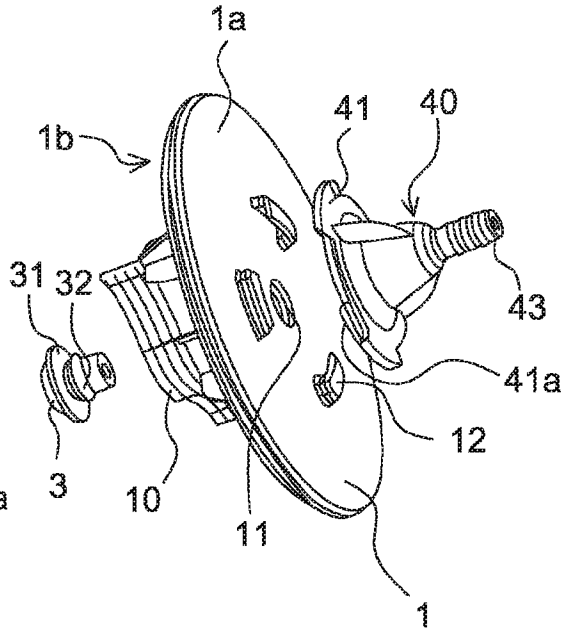
in FIG. 2: an exploded, perspective view of a combined device of the disclosed embodiment.
Figure 2:
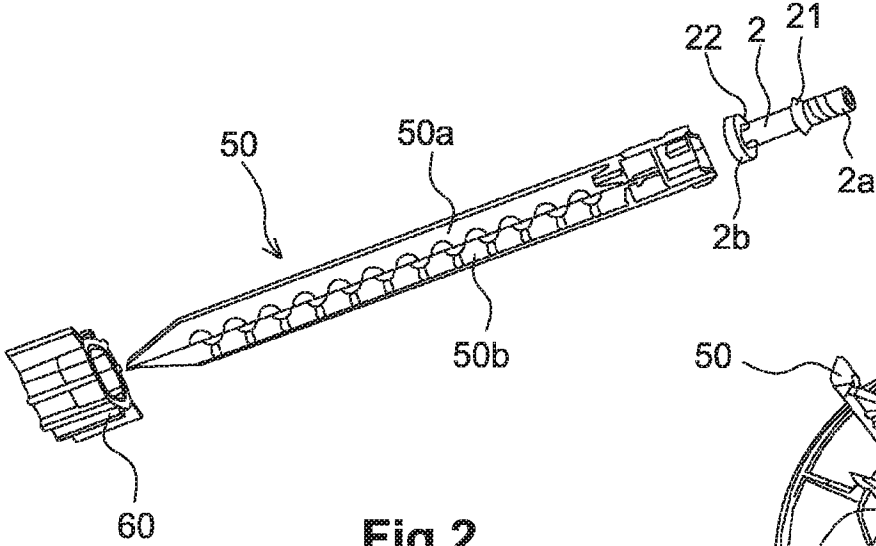

To do this and as represented in FIG. 2, the lid comprises an upper face 1*a* and a lower face 1*b*, and the lower face of the lid comprises a base 10 provided with a skirt for receiving the neck of a pocket 20 containing the product to be dispensed.

The base forms a housing for the valve mechanism consisting of a dispensing tube 2 and a sealing gasket 3.

The sealing gasket 3 is mounted on the dispensing tube between a base 2*b* and a shoulder 21 of the dispensing tube and when idle, the gasket 3 closes the openings 22 in the lower portion of the tube which fills the product outlet.

The sealing gasket mounted on the tube snap-fits into a through-hole 11 between the upper face of the lower face of the lid. The gasket comprises, to do this, two annular shoulders 31, between which the wall surrounding the hole 11 is housed. Once snap-fitted in the hole 11, the sealing gasket allows an outlet end 2*a* of the dispensing tube 2 to project beyond the upper face of the lid.

Figure 3:
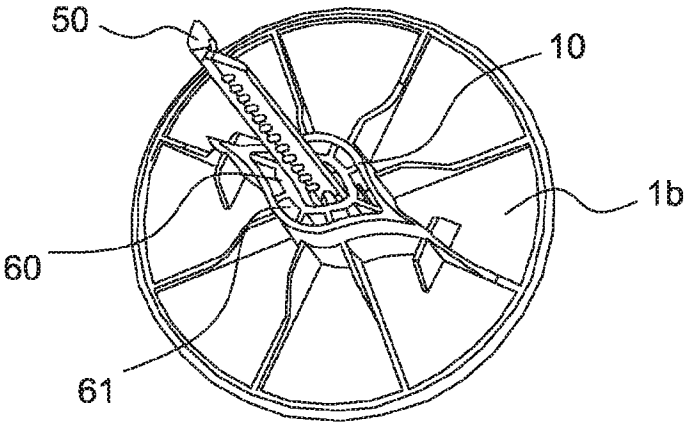
in FIG. 3: a perspective, bottom view of the device of FIG. 2.

The housing comprises a first cross-section 10*a* for receiving the valve mechanism as seen below and a second cross-section 10*b* for receiving an anti-lowering dip rod 50 as represented, in particular, in FIGS. 3 to 5.

Around the dip rod 50 is mounted a centring device 60 for holding the dip rod 50 in the second cross-section of the housing as represented in FIG. 32, in particular.

The centring device 60 is perforated to produce channels 61 for the product to be dispensed to pass through. According to FIGS. 4 and 5, the product can pass through the channels to raise in the cross-section 10*a* for receiving the valve mechanism and exit from the casing through the valve when it is in the open position.

Likewise, the dip rod comprises holes for the product to pass towards the valve 2.

The dip rod is used to avoid the pocket being flattened under pressure, which could cause a product wastage if the flattening is done at the top of the pocket on the valve side and is used to ensure that the pocket is emptied as much as possible.

Figure 7B:
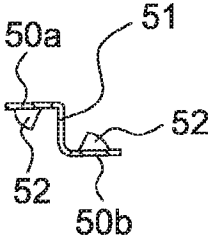
in FIGS. 7A, 7B: views, respectively perspective and cross-sectional, of a detail of a dip rod according to an aspect of the disclosed embodiment.
Figure 7A:
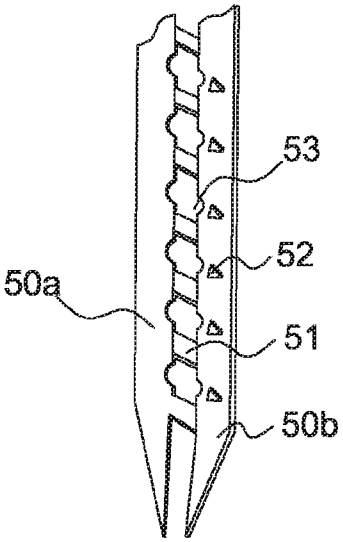

To make it possible for the product to flow along the dip rod when the pocket is compressed, the dip rod such as represented in FIGS. 7A in perspective and 7B in the cross-section comprises two mounts 50*a*, 50*b* connected by bars 51 for keeping the mounted away from one another, which provides a passage for the product along the rod to the valve 2.

The mounts are oriented parallel along a first direction and the bars are oriented along a direction perpendicular to the mounts as represented in FIG. 7B.

The rod further comprises teeth 52 defining an inner volume to the rod and facing the flattening of the pocket on the rod. Indentations 53 expanding the product passage zones into the space defined by the dip rod.

The combined lid 1 and valve mechanism 2, 3 device of the disclosed embodiment makes it possible to carry out single-pocket and cheap refills, since once the tube and the gasket of the valve are mounted in the lid and the dip rod is installed, it is sufficient to crimp or weld the neck of the pocket 20 onto the skirt 10 of the base to carry out a finished refill.

A pre-filled pocket can be used before welding on the base or the pocket can be filled through the valve used in the opposite direction by means of a filling accessory (not represented) being fixed temporarily on the cap and actuating the valve in the manner of the connector tip 40 described below.

The functioning of the high-flow valve-type valve remains conventional. FIG. 4 represents the valve closed by bearing a lower face of the gasket 3 against an upper face of an annular collar 2*b* under the valve and blocking the lower openings 22 of the product passage channels of the valve. FIG. 5 represents the valve opened by compression of the gasket 3 and recession of the valve 2. The compression of the gasket 3 spreads the annular collar portion 2*b* of the tube 2 and the base of the gasket which uncovers the openings 22 under the valve making it possible thus for the product to be dispensed to enter into the tube 2 through the openings 22 at the level of the lower end 2*b* of the tube and to emerge through the top 2*a* of the tube.

It is possible to move the valve directly with a pushbutton provided with an outlet nozzle but according to the example represented, a connector tip 40 provided with a collar 41 for fixing the connector tip on the upper face of the lid can be used, of a tubular portion 42 for receiving the outlet end of the dispensing tube and provided with an outlet tube 43.

In this case, the connector tip, once mounted on the lid, will open the valve permanently to, for example, dispense the product towards a deported dosing device connected to the casing, for example, by a tube 101 as represented in FIG. 1A.

Figure 5:
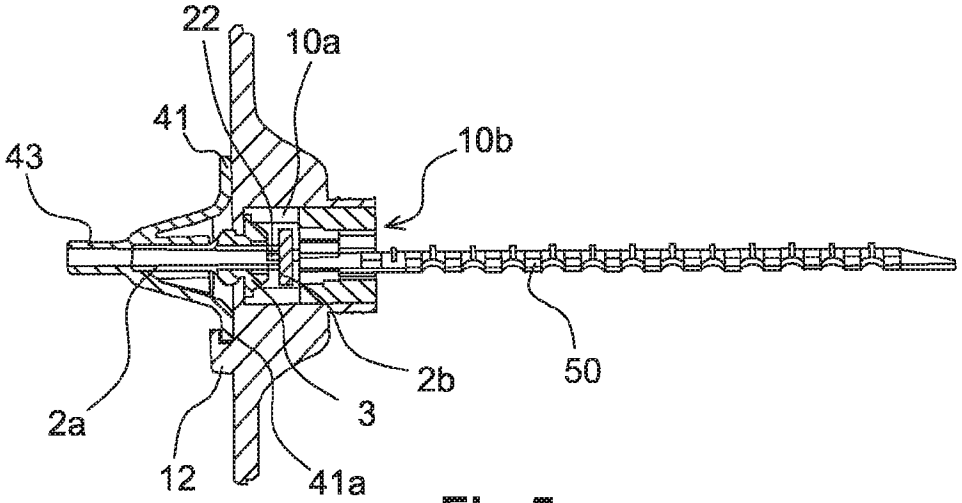

To do this, the tubular portion 42 of the connector tip is sized to push the dispensing tube and open the valve for dispensing the product during the fixing of the connector tip on the lid as represented in the position of FIG. 5. Returning to FIG. 2, the lid comprises fixing means 12, here made in the form of studs or pads provided with grooves, notches or slots wherein peripheral strips 41*a* are housed, distributed around the collar for fixing the connector tip.

Figure 4:
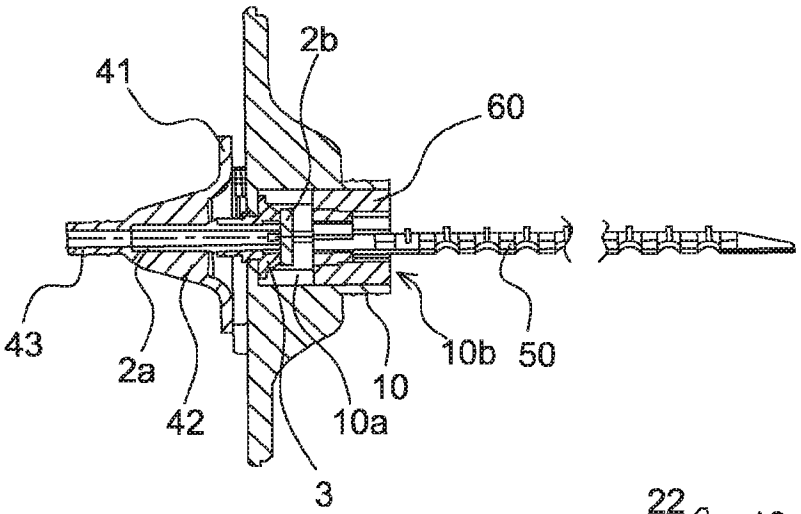
in FIGS. 4 and 5: cross-sectional views of the device of FIG. 2 according to the respectively closing and opening valve positions.

To use the casing, the connector tip, on which is for example connected a pipe going towards a dispensing device, is applied on the tube 2 as represented in FIG. 4, then sunken and rotated to engage the strips in the grooves as represented in FIG. 5 and block the valve 2 in the open position, once the connector tip is secured to the lid 1.

Figure 6:
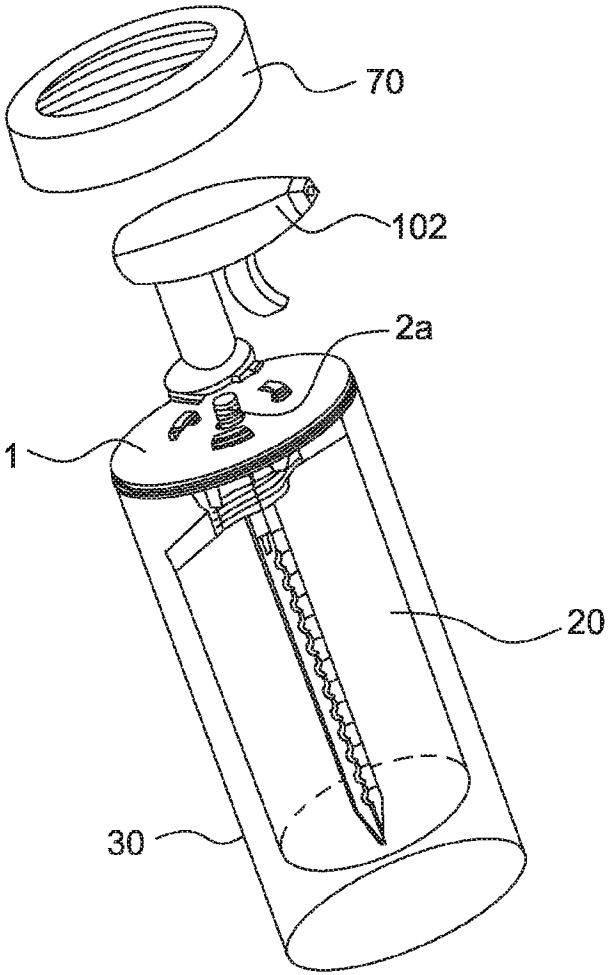
in FIG. 6: a perspective view of an example of using a casing of the disclosed embodiment with a gun.

The disclosed embodiment is not limited to the example represented, and for example, the fixing means 12 can, in the scope of the disclosed embodiment, be produced in another manner, for example, in the form of hooks and, as represented in FIG. 6, the device can receive an accessory for dispensing the product such as a gun 102 provided with a trigger actuating the value on demand or also a connector tip bearing a pushbutton actuating the valve on demand.

What is claimed is:

1. A combined lid/valve device comprising a lid, for a pressurised product dispensing container; and a valve mechanism;

wherein the lid is provided with a so-called upper face and a so-called lower face, in which the lower face of the lid comprises a base provided with a skirt for receiving the neck of a pocket containing the product to be dispensed, the base forming a housing for the valve mechanism consisting of a dispensing tube and a sealing gasket, and in which the sealing gasket mounted on the dispensing tube snap-fits into a through-hole between the upper face and the lower face of the lid by allowing an outlet end of the dispensing tube to project beyond the upper face of the lid wherein the upper face of the lid comprises means for fixing and accessory for dispensing the product, wherein the accessory consists of a connector tip provided with a collar for fixing the connector tip on the upper face of the lid, a tubular portion for receiving the outlet end of the dispensing tube and provided with an outlet tube, in which the tubular portion of the connector tip is sized to push the dispensing tube and open the valve for dispensing the product during the fixing of the connector tip on the lid, wherein the collar for fixing the connector tip comprises peripheral strips being housed in the grooves, notches or blocking slots provided on the upper face of the lid, said grooves, notches or slots forming said fixing means.

2. The combined lid/valve device according to claim 1, in which the accessory consists of a dispensing tip.

3. The combined lid/valve device according to claim 1, in which the accessory consists of a dispensing gun.

4. The combined lid/valve device according to claim 1, in which the housing comprises a first cross-section for receiving the valve mechanism and a second cross-section for receiving an anti-lowering dip rod.

5. The combined lid/valve device according to claim 4 comprising a centring device for keeping the dip rod inserted in said second cross-section of the housing.

6. The combined lid/valve device according to claim 5, in which the centring device is perforated to produce channels for product to be dispensed to pass through.

7. A refill, for pressurised product dispensing casing, comprising a combined lid/valve device according to claim 1.

8. The refill according to claim 7, provided with an anti-lowering dip rod, for which the dip rod comprises two mounts connected by bars for keeping the mounts away from one another.

9. The refill according to claim 8, in which the rod comprises teeth facing the flattening the pocket on the rod and indentations expanding the product passage zones in the space defined by the dip rod.

10. A pressurised product dispensing casing comprising a refill according to claim 7, in which the combined lid/valve device is held on the container of the casing by a ring fixed on the container.

* * * * *